US007217879B2

(12) United States Patent
Ito

(10) Patent No.: US 7,217,879 B2
(45) Date of Patent: May 15, 2007

(54) REVERBERATION SOUND GENERATING APPARATUS

(75) Inventor: Tsugio Ito, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 461 days.

(21) Appl. No.: 10/805,021

(22) Filed: Mar. 19, 2004

(65) Prior Publication Data

US 2004/0187672 A1 Sep. 30, 2004

(30) Foreign Application Priority Data

Mar. 26, 2003 (JP) ..... 2003-086289

(51) Int. Cl.
*G10H 1/02* (2006.01)
*G10H 7/00* (2006.01)

(52) U.S. Cl. ..... 84/630; 381/63

(58) Field of Classification Search ..... 84/626, 84/630; 381/63

See application file for complete search history.

(56) References Cited

U.S. PATENT DOCUMENTS 5,317,104 A * 5/1994 Frost ..... 84/625
5,438,623 A * 8/1995 Begault ..... 381/17
5,744,742 A * 4/1998 Lindemann et al. ..... 84/623
7,039,194 B1 * 5/2006 Kemp ..... 381/61

FOREIGN PATENT DOCUMENTS

| | | |
|---|---|---|
| JP | 05-047840 | 7/1993 |
| JP | 07-181989 | 7/1995 |
| JP | 08-202392 | 8/1996 |
| JP | 2000-097763 | 4/2000 |

* cited by examiner

*Primary Examiner*—Jeffrey W Donels
(74) *Attorney, Agent, or Firm*—Morrison & Foerster LLP

(57) ABSTRACT

A reverberation apparatus is designed for generating a reverberation sound from an input sound with use of an impulse response based on an instruction. In the reverberation apparatus, a first storage section stores first impulse response data representative of a first impulse response. A second storage section stores second impulse response data representative of a second impulse response which is different from the first impulse response represented by the first impulse response data. A new data creating section operates based on the first impulse response data and the second impulse response data for creating new impulse response data representative of a new impulse response in accordance with the instruction. A reverberation sound generating section generates reverberation sound data representative of the reverberation sound by filtering input sound data representative of the input sound with use of the new impulse response data, such that the generated reverberation sound is featured by the new impulse response.

15 Claims, 7 Drawing Sheets

101 : REVERBERATION SOUND GENERATING APPARATUS

101 : REVERBERATION SOUND GENERATING APPARATUS

102 : REVERBERATION SOUND GENERATING APPARATUS

REVERBERATION SOUND GENERATING APPARATUS

BACKGROUND OF THE INVENTION

1. Technical Field of the Invention

The present invention relates generally to a technology for generating reverberation sounds for a variety of music sounds such as performance sounds of musical instruments and singing voices.

2. Prior Art

Apparatuses are known in which a reverberation sound is artificially imparted to an input sound. In such apparatuses, it is a general practice that an impulse response is measured beforehand in an acoustic space such as a concert hall, and a convoluting computation based on this impulse response is applied to the input sound, thereby generating a reverberation sound. In addition, configurations have been proposed in which such various characteristics associated with the reverberation sound as reverberation time and frequency characteristic can be changed. For example, patent document 1 indicated below discloses a configuration in which a plurality of impulse responses having different characteristics are prepared and any one of these impulse responses is selectively used, thereby appropriately changing reverberation sound characteristics.

Patent document 1 is Japanese Patent publication No. Hei 5-47840. The related description is presented on page 4 of Patent document 1.

In the above-mentioned configuration, however, numerous impulse response data must be prepared, thereby causing a problem of increasing the scale of a storage unit for storing these data. To avoid this problem, the amount of the impulse response data may be decreased but at the cost of rough or coarse tuning of the reverberation sound characteristics, resulting in the inability to finely tune these characteristics.

SUMMARY OF THE INVENTION

It is therefore an object of the present invention to provide a reverberation sound generating apparatus and a program which are capable of finely and continuously changing reverberation sound characteristics while decreasing the number of impulse response data which are stored beforehand.

In carrying out the invention and according to one aspect thereof, there is provided an apparatus for generating a reverberation sound from an input sound with use of an impulse response based on an instruction. The inventive apparatus comprises a first storage section that stores first impulse response data representative of a first impulse response, a second storage section that stores second impulse response data representative of a second impulse response which is different from the first impulse response represented by the first impulse response data, a new data creating section that operates based on the first impulse response data and the second impulse response data for creating new impulse response data representative of a new impulse response in accordance with the instruction, and a reverberation sound generating section that generates reverberation sound data representative of the reverberation sound by filtering input sound data representative of the input sound with use of the new impulse response data, such that the generated reverberation sound is featured by the new impulse response.

According to the above-mentioned configuration, the new impulse response data representative of an impulse response in accordance with user instruction is generated on the basis of the first impulse response data and the second impulse response data to generate reverberation sound data by executing filter processing by use of the new impulse response data. Consequently, it is unnecessary to prepare large amounts of impulse response data for changing reverberation sound characteristics. Besides, the prepared impulse response data are not selectively used, but new impulse response data are generated from time to time, hence the reverberation sound characteristics may be continuously changed.

The reverberation sound generating apparatus associated with the invention may be used to change the reverberation time and frequency characteristic of the reverberation sound. In order to change the reverberation times, a configuration may be provided in which the second storage section stores the second impulse response data representative of the second impulse response which has a reverberation time different from that of the first impulse response represented by the first impulse response data, and the new data creating section creates the new impulse response data representative of the new impulse response having a reverberation time which is derived from the reverberation times of the first impulse response and the second impulse response in accordance with the instruction.

On the other hand, in order to change the frequency characteristics, another configuration may be provided in which the second storage section stores the second impulse response data representative of the second impulse response which has a frequency characteristic different from that of the first impulse response represented by the first impulse response data, and the new data creating section creates the new impulse response data representative of the new impulse response having a frequency characteristic which is derived from the frequency characteristics of the first impulse response and the second impulse response in accordance with the instruction.

Expediently in the present invention, the second impulse response data may be those obtained by manipulating the first impulse response data. Consequently, an echo pattern corresponding to the first impulse response data may be matched with another echo pattern corresponding to the second impulse response data along time axis, thereby easily generating new impulse response data by use of the first impulse response data and the second impulse response data. This configuration also provides an advantage that the echo pattern corresponding to the new impulse response generated may be matched with the echo pattern in the first impulse response along time axis. Further, once the second impulse response data have been generated as described above, new impulse response data may easily be generated subsequently by use of these data, so that the processing for obtaining the second impulse response data from the first impulse response data may be executed only once before generating a reverberation sound even if this processing is complicated and requires time. As compared with a configuration in which the second impulse response data are generated every time new impulse response data are generated, the novel configuration shortens the time interval between the issuance of user instruction and the reflection of the user instruction onto an actual reverberation sound.

Preferably in the present invention, the new data creating section creates the new impulse response data by linearly combining the first impulse response data and the second impulse response data with each other in accordance with the instruction. This configuration may simplify computation processing as compared with a configuration in which new impulse response data are generated by multiplying the prepared impulse response data by an exponential function for example. Consequently, the time interval between the issuance of user instruction and the reflection of the user instruction onto an actual reverberation sound may be shortened, thereby implementing realtime processing, which allows the user to change reverberation characteristics as desired while confirming the actual change in reverberation sound.

A configuration is also desirable in which the new data creating section divides the first impulse response data into a sequence of first blocks along a time axis, divides the second impulse response data into a sequence of second blocks along the time axis, and creates a sequence of blocks of the new impulse response data arranged along the time axis in correspondence to the sequence of the first blocks of the first impulse response data and the sequence of the second blocks of the second impulse response data, and in which the reverberation sound generating section divides the input sound data into a sequence of blocks along the time axis in correspondence to the sequence of the blocks of the new impulse response data, then filters each block of the input sound data with use of each block of the new impulse response data, and sums the filtered results altogether to generate the reverberation sound data.

This configuration allows the adjustment of parameters for use in the computation for each block, thereby reducing errors between the new impulse response data specified by the user and the new impulse response data actually generated may be reduced as compared with a configuration in which all the impulse response data are processed in a batch over the entire length of impulse response.

Further, a configuration is desirable in which the new data creating section separates the first impulse response data into a plurality of frequency components, also separates the second impulse response data into a plurality of frequency components, then executes a computation for each of the plurality of the frequency components between the first impulse response data and the second impulse response data according to the instruction, and sums results of the computation altogether to generate the new impulse response data.

This configuration provides an advantage of making the reverberation characteristics versatile because the change of characteristics may be made for each of the frequency components of reverberation sound.

The present invention also includes a program executable by a computer for generating a reverberation sound from an input sound with use of an impulse response based on an instruction.

To be more specific, this program comprises a first providing step of providing first impulse response data representative of a first impulse response, a second providing step of providing second impulse response data representative of a second impulse response which is different from the first impulse response represented by the first impulse response data, a new data creating step of creating new impulse response data representative of a new impulse response based on the first impulse response data and the second impulse response data in accordance with the instruction, and a reverberation sound generating step of generating reverberation sound data representative of the reverberation sound by filtering input sound data representative of the input sound with use of the new impulse response data, such that the generated reverberation sound is featured by the new impulse response.

The program associated with the present invention may be installed on the computer through a network or from various recording media such as optical disk, magnetic disk, and magneto-optical disk for example.

DETAILED DESCRIPTION OF THE INVENTION

This invention will be described in further detail by way of example with reference to the accompanying drawings.

Figure 1:
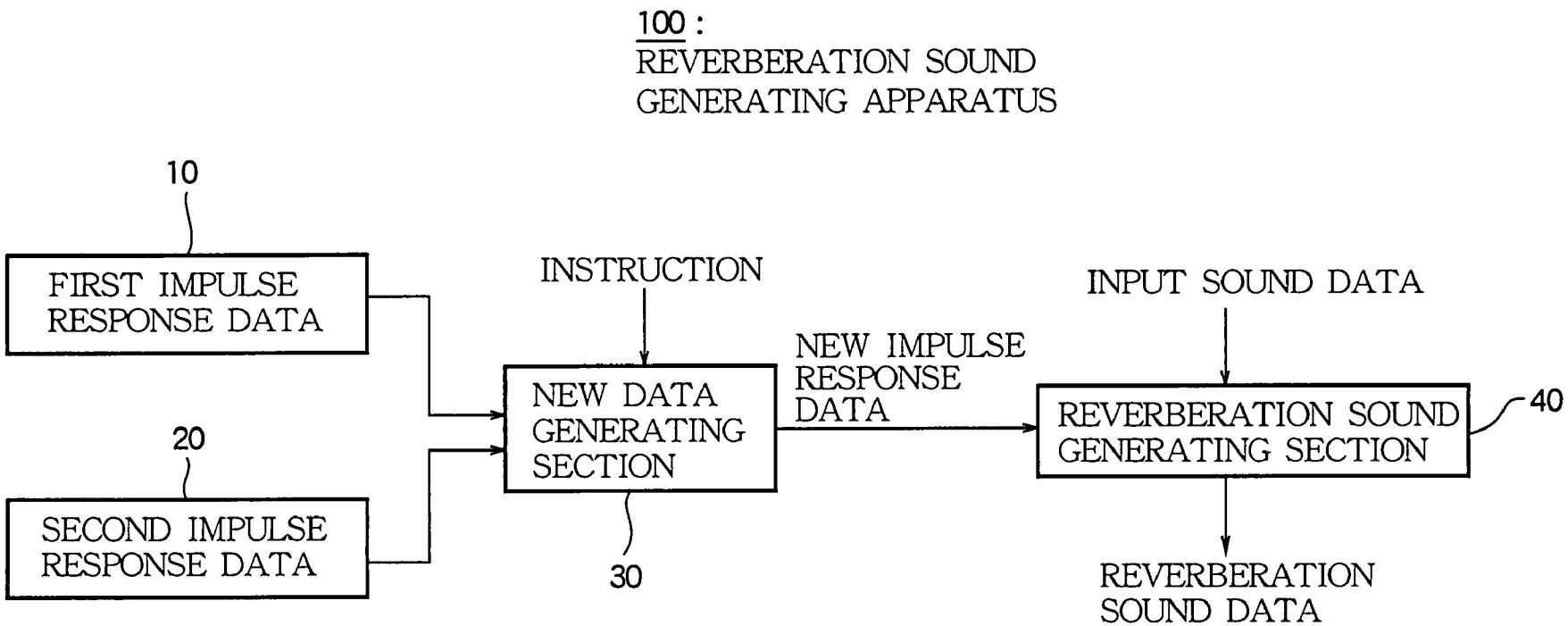
FIG. 1 is a block diagram illustrating a conceptual configuration of a reverberation sound generating apparatus according to the invention.

Now, referring to FIG. 1, a reverberation sound generating apparatus according to the invention will be outlined. This reverberation sound generating apparatus artificially generates reverberation sounds of music sounds such as musical instrument sounds (hereafter referred to as input sounds) and, at the same time, controls characteristics of the reverberation sound such as a reverberation time and a frequency characteristic. As shown in FIG. 1, the inventive reverberation sound generating apparatus 100 has storage units 10 and 20, a new data creating section 30, and a reverberation sound generating section 40. In this configuration, the new data creating section 30 and the reverberation sound generating section 40 may be implemented by either hardware such as DSP (Digital Signal Processor) or the combination of the hardware such as CPU (Central Processing Unit) and the software or programs which are executed by the CPU.

The storage units 10 and 20 each provide a means for storing data and are constituted by a semiconductor memory or a hard disk drive for example. The storage unit 10 stores first impulse response data representative of impulse responses. The first impulse response data are obtained by generating an impulse in an acoustic space such as a concert hall or a church and sampling the reverberation sound generated by this impulse as an impulse response. On the other hand, the storage unit 20 stores second impulse response data. The second impulse responses data which represent an impulse response different in characteristic from the impulse response presented by the first impulse response data. For example, the second impulse response data are generated by converting the first impulse responses data in accordance with a predetermined algorithm.

A user may appropriately operate controls (for example, knobs), not shown, to inform the new data creating section 30 of a desired reverberation sound characteristic. On the basis of the first impulse response data and the second impulse response data, the new data creating section 30 generates new data representative of an impulse response in accordance with a user instruction (hereafter referred to as "new impulse response data." It should be noted that, in what follows, the impulse responses represented by the first and second impulse response data are referred to as "the first impulse response" and "the second impulse response" respectively and the impulse response represented by the new impulse response data is referred to as "the new impulse response."

Figure 2:
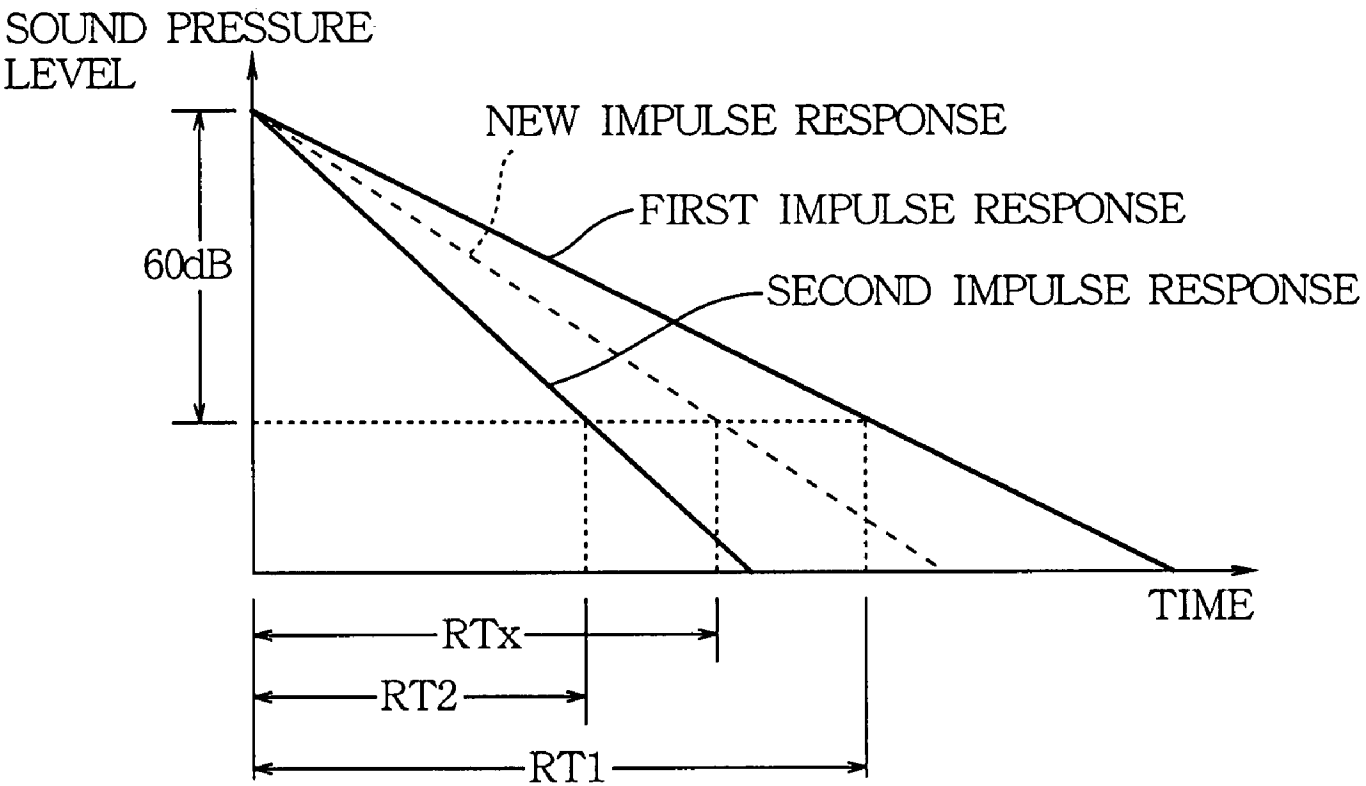
FIG. 2 is a graph for describing a general concept of new impulse response data created in the above-mentioned reverberation sound generating apparatus.

FIG. 2 is a graph indicative of a relationship between the first impulse response, the second impulse response, and the new impulse response. Especially focused here is a reverberation time, one of the reverberation sound characteristics. A reverberation time denotes a duration of time in which, after an input signal for generating a tone has stopped, the sound pressure level of the tone generated in accordance with that signal attenuates by 60 dB. To be more specific, the first impulse response has a reverberation time of duration RT1 while the second impulse response has a reverberation time of duration RT2. On the basis of the first impulse response data and the second impulse response data, the new data creating section 30 generates new impulse response data of an impulse response having reverberation time RTx specified by the user. It should be noted that reverberation time RTx is not limited to a value within a range of RT2=RTx=RT1. Namely, if an error from a desired reverberation time does not present a problem, reverberation time RTx may be set to any value within a range of RTx=RT2 or RT1=RTx. In this example, special attention is paid to reverberation time as a reverberation sound characteristic; however, the characteristics to be changed by the user are not limited to reverberation time.

On the other hand, as shown in FIG. 1, the data representative of a sound subjected to reverberation sound generation (the data hereafter referred to as "input sound data") are supplied to the reverberation sound generating section 40. On the basis of the new impulse response data generated by the new data creating section 30, the reverberation sound generating section 40 provides a means for generating data with the input sound imparted with a reverberation sound (the data hereafter referred to as "reverberation data"). To be more specific, the reverberation sound generating section 40 performs filtering by use of the new impulse response data onto the input sound data to generate reverberation sound data. As described above, because the instruction by the user is reflected on the new impulse response data, the reverberation sound generated by the reverberation sound generating section 40 comes to have a characteristic which is in accordance with the user instruction. For example, in the case of the new impulse response shown in FIG. 2, a reverberation sound with reverberation time being RTx is generated.

As described above, according to the above-mentioned reverberation sound generating apparatus associated with the invention, reverberation sound characteristics may be appropriately changed according to user instruction. Because new impulse response data are generated on the basis of first impulse response data and the second impulse response data, it is not necessary to prepare large amounts of impulse response data which are changed by the user. Consequently, the above-mentioned configuration can reduce the storage capacity for storing impulse response data. Besides, because the prepared impulse response data are not selectively used, but new impulse response data are generated from time to time, reverberation sound characteristics can be continuously changed in accordance with user instruction.

<1: First Embodiment>

Figure 3:
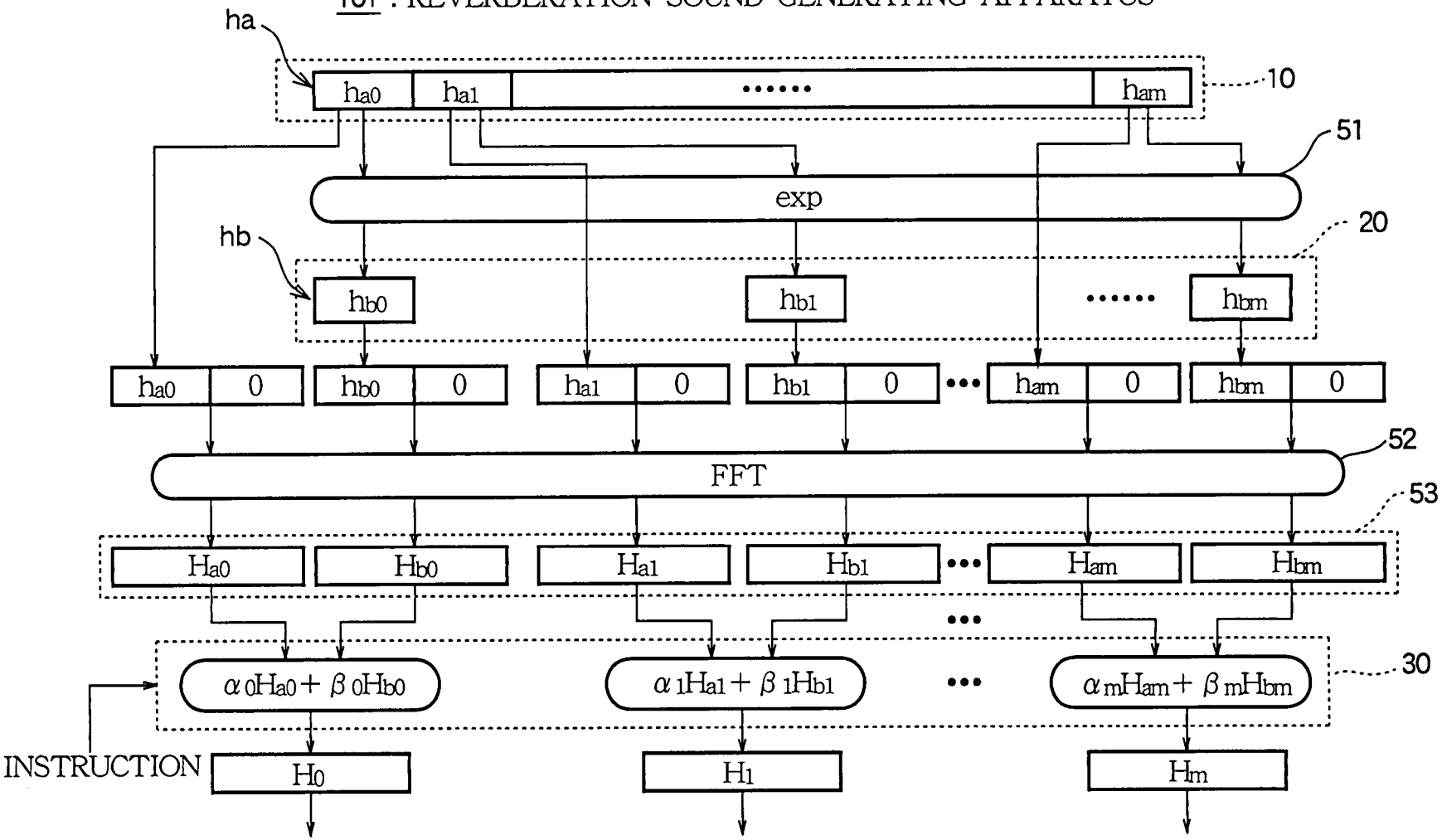
FIG. 3 is a block diagram illustrating a configuration for generating new impulse response data in a reverberation sound generating apparatus practiced as a first embodiment of the invention.
Figure 4:
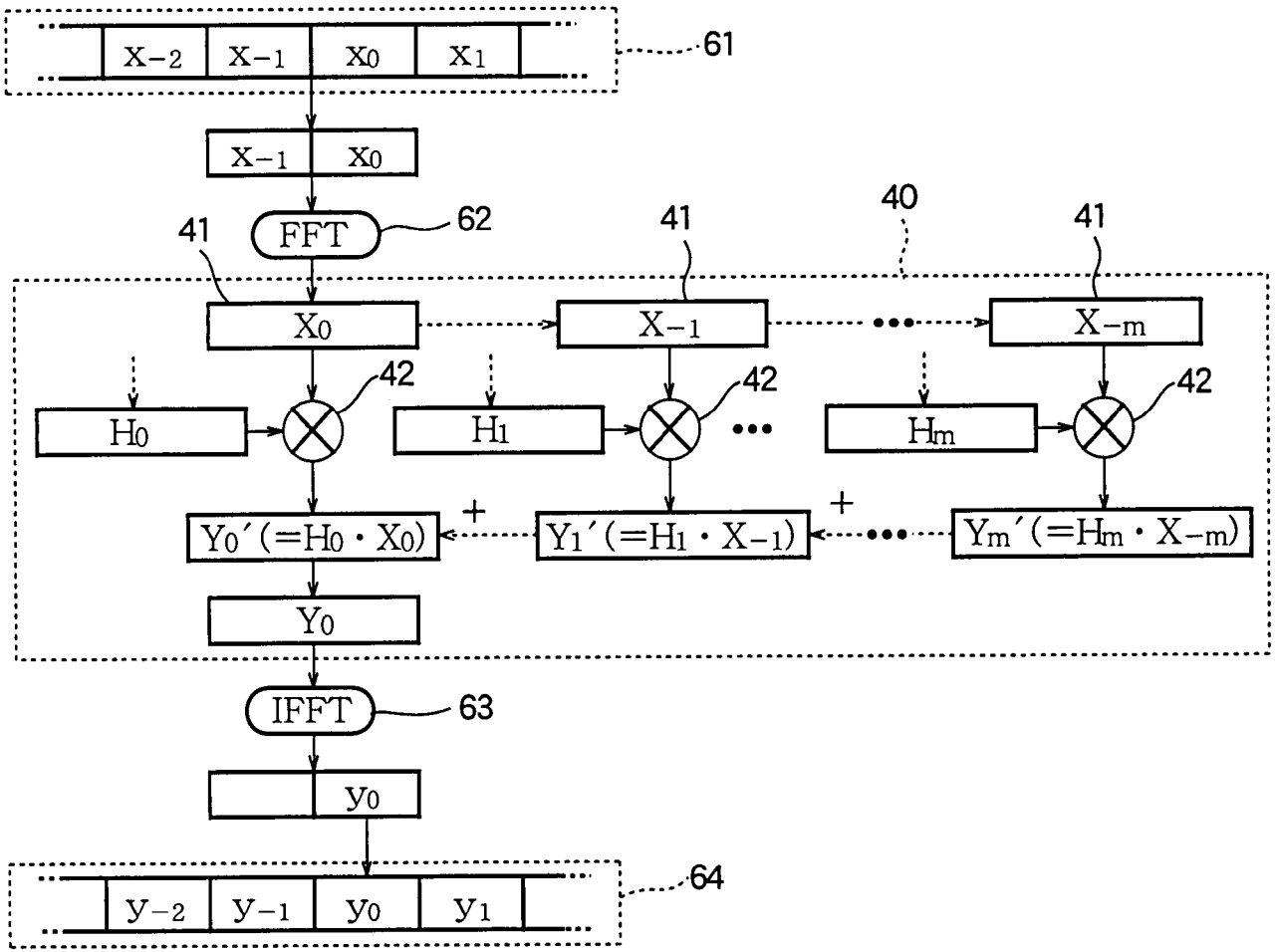
FIG. 4 is a block diagram illustrating a configuration for generating reverberation sound data in the above-mentioned reverberation sound generating apparatus.

The following describes a reverberation sound generating apparatus practiced as a first embodiment of the invention with reference to FIGS. 3 and 4. The reverberation sound generating apparatus according to the first embodiment is adapted to change the reverberation time of each reverberation sound in accordance with user instruction. It should be noted that, with reference to FIGS. 3 and 4, components similar to those previously described with reference to FIG. 1 are denoted by the same reference numerals.

As shown in FIG. 3, a reverberation sound generating apparatus 101 has a storage unit 10 for storing first impulse response data ha. The first impulse response data ha are divided on the time axis into a total of (m+1) blocks, from block ha0 to block ham. Each block hak (k being an integer that satisfies 0=k=m) includes N sampling data obtained from the first impulse response.

An exponent operating block 51 provides a means for manipulating first impulse response data ha to generate second impulse response data hb. To be more specific, the exponent operating block 51 generates second impulse response data hb by multiplying first impulse response data ha by an exponential window (namely, by an exponential function). Second impulse response data hb thus generated are stored in a storage unit 20. Like first impulse response data ha, second impulse response data hb are divided into a total of (m+1) blocks (from block hb0 to block hbm) each including N sampling data.

An FFT block 52 shown in FIG. 3 performs FFT (Fast Fourier Transform) on each pair of block hak and N zero-data blocks for each block hak of the first impulse response data ha stored in the storage unit 10. Data group Hak (hereafter referred to as "first frequency element block") obtained by performing FFT is stored in a storage unit 53. This storage unit 53 is constituted by a semiconductor memory or a hard disk drive for example. On the other hand, FFT is also performed, for each block hbk, on the second impulse response data hb stored in the storage unit 20 after summing zero-data blocks. The resultant data are stored in the storage unit 53 as second frequency element block Hbk. The above-mentioned processing, namely the processing of generating the first and second frequency element blocks from the first and second impulse response data, is executed only once before the input sound data are supplied to the reverberation sound generating apparatus 101 for example.

On the other hand, a new data creating section 30 linearly combines the first frequency element block Hak and the second frequency element block Hbk and outputs the resultant data as a block of new impulse response data (hereafter referred to as "new impulse response block") Hk. Namely, the new impulse response block Hk is computed from equation (1) shown below.

$$Hk=\alpha k\cdot Hak+\beta k\cdot Hbk \quad (1)$$

where coefficient ak and βk are given from the following equations (2a) and (2b) respectively.

$$\alpha k = \frac{c^{\left(\frac{T0}{RTx}+\frac{T1}{RT2}\right)} - c^{\left(\frac{T1}{RTx}+\frac{T0}{RT2}\right)}}{c^{\left(\frac{T0}{RT1}+\frac{T1}{RT2}\right)} - c^{\left(\frac{T1}{RT1}+\frac{T0}{RT2}\right)}} \tag{2a}$$

$$\beta k = \frac{c^{\left(\frac{T0}{RT1}+\frac{T1}{RTx}\right)} - c^{\left(\frac{T1}{RT1}+\frac{T0}{RTx}\right)}}{c^{\left(\frac{T0}{RT1}+\frac{T1}{RT2}\right)} - c^{\left(\frac{T1}{RT1}+\frac{T0}{RT2}\right)}} \tag{2b}$$

In these equations (2a)a and (2b), T0 denotes a time from the start point of impulse response to the start point of the block to be linearly combined and T1 denotes a time from the start point of impulse response to the end point of that block. On the basis of the above-mentioned definition of reverberation time, c is 0.001 ($=10^{-60/20}$). As shown in FIG. 2, RT1 denotes the reverberation time of the first impulse response, RT2 denotes the reverberation time of the second impulse response, and RTx denotes the reverberation time in accordance with user instruction. Thus, coefficients ak and βk for linear combination are those reflecting reverberation time RTx in accordance with user instruction, so that the new impulse response data to be generated by the new data creating section 30 represent an impulse response with reverberation time being RTx. In addition, when the user gives an instruction for changing reverberation sound characteristics, the new data creating section 30 newly computes coefficients ak and βk corresponding to the characteristic after change, thereby obtaining the new impulse response data again by the linear combination based on the changed coefficients. Consequently, the reverberation sound characteristics continuously change as instructed by the user.

The following describes in detail a configuration for generating a reverberation sound by use of new impulse response data with reference to FIG. 4. As shown in the figure, the input sound data supplied to the reverberation sound generating apparatus 101 are sequentially stored in an input buffer 61. Like impulse response data, these input sound data are divided into blocks xj (j being an integer) including N sampling data and use for the generation of the reverberation sound for each block xj. In what follows, as shown in FIG. 4, the block currently subject to the generation of reverberation sound is "block x0" and the blocks (old blocks) inputted temporally before this block are denoted as "block x−1", "block x−2", and so on by use of a negative sign as subscript.

An FFT block 62 performs FFT on a pair of block x0 subjected to reverberation sound generation and immediately preceding block x−1. A data group (hereafter referred to as "input sound block") of frequency range outputted from the FFT block 62 are inputted in a reverberation sound generating section 40.

The reverberation sound generating section 40 has (m +1) stages of storage units 41. Input sound block X0 supplied from the FFT block 62 is first stored in the first stage of the storage unit 41. Next, every time the generation of reverberation sound for block x0 has ended and the processing shifts to the next block, the input sound block stored in one stage of the storage unit 41 is shifted to the next stage. Therefore, (m+1) stages of storage unit 41 store currently processed input sound block X0 and m input sound blocks processed before, namely input sound block X−1 through input sound block X-m, as shown in FIG. 4.

The reverberation sound generating section 40 also has a total of (m+1) multipliers arranged after the stages of storage units 41, one to one. Each of these multipliers 42 is supplied with one corresponding new impulse response block Hk among the new impulse response data outputted from the new data creating section 30. For example, new impulse response block H0 is supplied to the first stage of multiplier 42, new impulse response block H1 is supplied to the second stage of multiplier 42, and so on up to that new impulse response block Hm is supplied to the (m+1) stage of multiplier 42. Each multiplier 42 multiplies input sound block X-k stored in the corresponding stage of storage unit 41 by new impulse response block Hk supplied from the new data creating section 30 and outputs a result of the multiplication. To be more specific, the first stage of multiplier 42 multiplies input sound block X0 by new impulse response block H0, the second stage of multiplier 42 multiplies input sound block X−1 by new impulse response block H1, and so on up to that the (m+1) stage of multiplier 42 multiplies input sound block X-m by new impulse response block Hm. Then, a total of (m+1) blocks from block Y0' to block Ym' obtained by these multiplying operations are added and outputted from the reverberation sound generating section 40 as reverberation sound block Y0. Namely, the reverberation sound generating section 40 executes convolution of the new impulse response data on the input sound data.

Next, a reverse FFT block 63 shown in FIG. 4 performs reverse FFT reverberation sound block Y0 outputted from the reverberation sound generating section 40 to convert it into data on the time axis. Of these data obtained as a result of this reverse FFT processing, the first half is discarded and the remaining half is outputted as block y0 which is one of blocks of the reverberation sound data. Each block y0 of reverberation sound data thus obtained is sequentially stored in an output buffer 64. Subsequently, in the same procedure as above, reverberation sound data are generated for each block xj of input sound data. On the other hand, the reverberation sound data stored in the output buffer 64 are read in a predetermined timed relation and converted by a D/A converter (not shown) into an analog signal, which is sounded from an output means such as a speaker or earphone for example.

As described and according to the above-mentioned first embodiment of the invention, new impulse response data Hk are generated on the basis of the first impulse response data hak and the second impulse response data hbk, so that large amounts of impulse response data to be selected by the user need not be held beforehand. Therefore, the storage capacity for storing impulse response data may be reduced. Besides, because prepared impulse response data are not selectively used, but new impulse response data are generated from time to time, the reverberation sound characteristics may be continuously changed in accordance with user instruction.

The processing of generating the second impulse response data from the first impulse response data may be executed only once before input sound data are supplied to the reverberation sound generating apparatus 101 for example. Here, for another configuration for getting the impulse response data of a reverberation sound characteristic corresponding to user instruction, a configuration may be proposed in which, the prepared first impulse response data are multiplied by an exponential function with a parameter selected in accordance with user instruction. However, in such a configuration, every time an instruction is given by the user for changing characteristics, a fairly time-consuming computation must be performed in the multiplication of exponential functions, thereby making it difficult to quickly reflect the contents of user instruction on reverberation sound characteristics. On the contrary, in the first embodiment, the computational processing of getting the second impulse response data by multiplying the first impulse response data by an exponential function may be executed only once before and, for the generation of new impulse response data, the linear combination which is comparatively small in computational amount may only be executed. Consequently, according to the first embodiment, the instructions given by the user may be quickly reflected on the processing of changing reverberation sound characteristics. As a result, the user may adjust the reverberation sound characteristic as desired while actually listening to the changing of reverberation sound characteristics.

Further, in the first embodiment, the first and second impulse response data are divided into blocks and the generation of a new impulse response block and the multiplication by the multiplier 42 are executed for each of these blocks, so that the error between the new impulse response data specified by the user and the new impulse response data actually generated may be reduced as compared with a configuration in which all the impulse response data are processed in a batch without dividing them into blocks.

<2: Second Embodiment>

The following describes a reverberation sound generating apparatus practiced as a second embodiment of the invention.

In the first embodiment, the configuration is presented in which the change in reverberation time is executed in accordance with user instruction. The reverberation sound characteristics to be controlled by user instruction is not limited to this configuration in the present invention. The reverberation sound generating apparatus according to the second embodiment is adapted to control frequency characteristic in accordance with user instruction. To be more specific, of each reverberation sound, the sound pressure level in the high frequency band (hereafter referred to as "high key range" is appropriately changed in accordance with user instruction.

Figure 5:
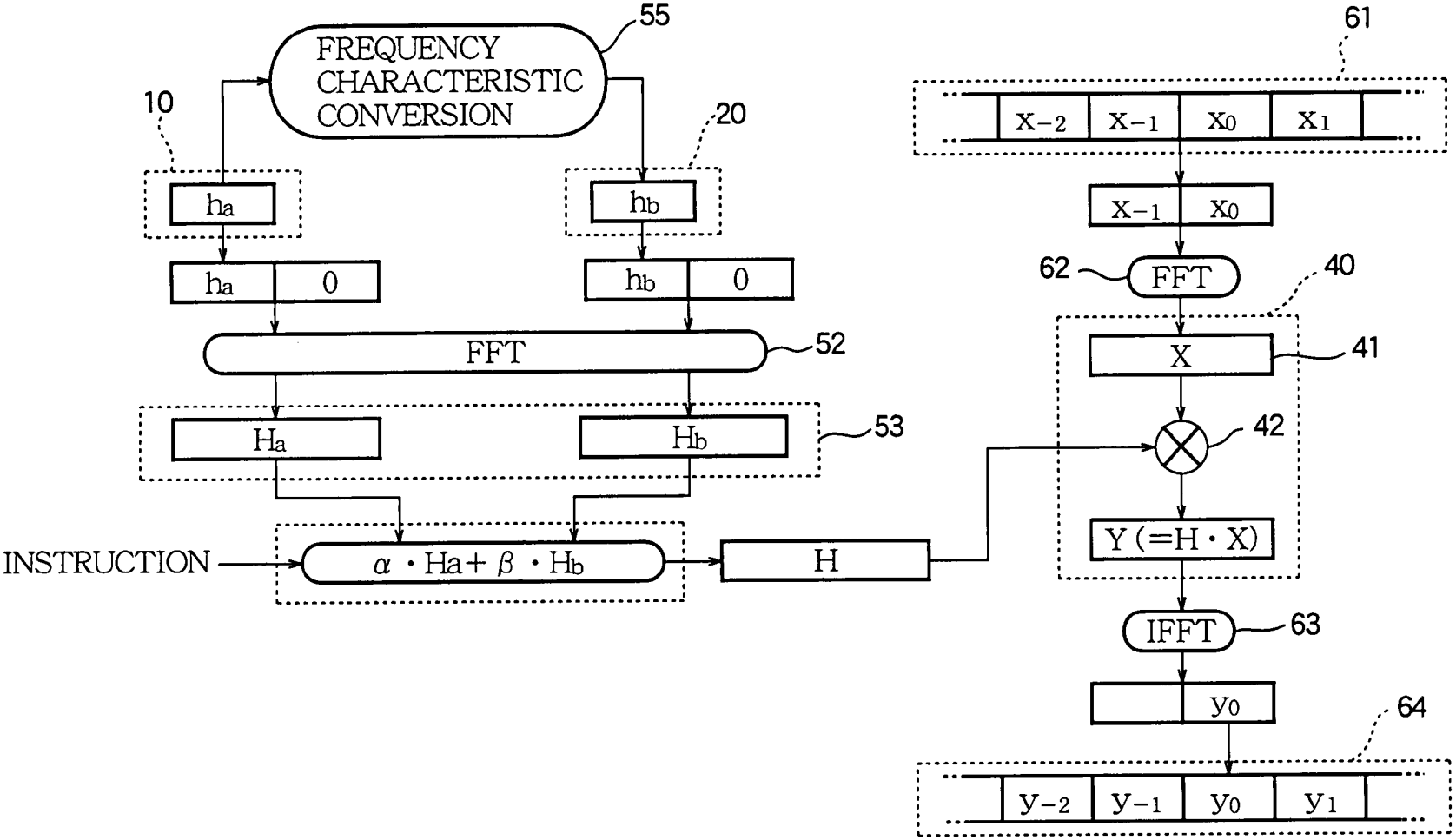
FIG. 5 is a block diagram illustrating a configuration of a reverberation sound generating apparatus practiced as a second embodiment of the invention.

FIG. 5 is a block diagram illustrating a configuration of the reverberation sound generating apparatus associated with the second embodiment. It should be noted that, with reference to FIG. 5, components similar to those previously described with reference to FIGS. 3 and 4 are denoted by the same reference numerals. In FIGS. 3 and 4, the configurations are presented in which each piece of impulse response data is divided into blocks. In FIG. 5, for the brevity of drawing and description, a plurality of blocks forming each piece of impulse response data are represented by one block ha. However, in the actual configuration, it is desirable to process each piece of impulse response data, block by block, as with the above-mentioned first embodiment.

Referring to FIG. 5, the a reverberation sound generating apparatus 102 practiced as the second embodiment has a frequency characteristics conversion block 55 instead of the exponent operating block 51 of the reverberation sound generating apparatus 101 associated with the first embodiment. The frequency characteristics conversion block 55 provides a means for generating, by filtering the first impulse response data ha stored in the storage unit 10, the second impulse response data hb representative of the second impulse response which is different in frequency characteristic (namely, the relationship between frequency and sound pressure level) from the first impulse response. This block is constituted by various filters for example. In the description of the second embodiment, an example is used in which an impulse response which increasingly attenuates as the key range goes higher, namely the difference from the sound pressure level of the first impulse response increases as the key range goes higher, is generated as the second impulse response.

A new data creating section 30 shown in FIG. 5 linearly combines the first frequency element block Ha obtained from the first impulse response data ha with the second frequency element block Hb obtained from the second impulse response data and outputs the resultant data to a multiplier 41 of the reverberation sound generating section 40 as a new impulse response block H (new impulse response data), as shown in equation (1) in the above-mentioned first embodiment. Coefficients a and β for use in this linear combination are appropriately determined in accordance with user instruction. Consequently, the characteristic of the new impulse response is determined between the first impulse response and the second impulse response of which sound pressure level in the high key range is lower than that of the first impulse response. The subsequent operations, namely the operations for generating reverberation sound data from new impulse response data are the same as those in the above-mentioned first embodiment. The second embodiment provides the same effects as those provided by the first embodiment.

In the above-mentioned example, the sound pressure level in the high key range in the first impulse response is changed to provide the second impulse response; however, the relationship between the first impulse response and the second impulse response is not limited thereto. For example, a configuration may be provided in which the first impulse response in a space enclosed by walls having a predetermined sound absorption characteristic is obtained by simulation or actual measurement, while the obtained impulse response is filtered, thereby obtaining an impulse response in a space enclosed by walls having a different sound absorption characteristic as the second impulse response. This configuration allows to continuously change the characteristics of a reverberation sound between the different sound absorption characteristics of different spaces. As described, in the present invention, any configuration may be provided as long as any characteristics associated with reverberation sound including reverberation time and frequency characteristic may be changed in accordance with user instruction.

<3: Third Embodiment>

Figure 6:
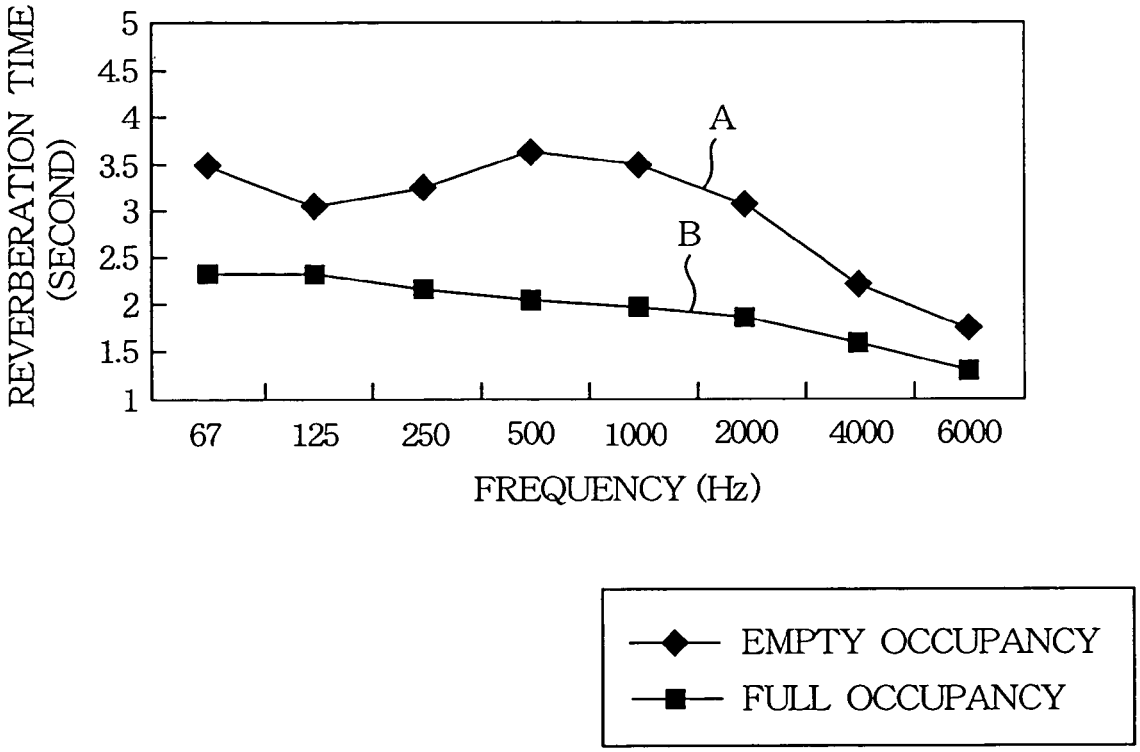
FIG. 6 is a graph indicative of a relation between a reverberation time and a sound frequency in a given acoustic space.

The following describes a reverberation sound generating apparatus practiced as a third embodiment of the invention. The reverberation sound generating apparatus associated with the third embodiment is adapted to change the reverberation time frequency characteristic of a reverberation sound in accordance with user instruction. The reverberation time frequency characteristic denotes the relationship between the frequency of a reverberation sound and the reverberation time of each frequency component. FIG. 6 is a graph showing both reverberation time frequency characteristic A at the time when a particular hall as an acoustic space is not occupied by audience and reverberation time frequency characteristic B at the time when this hall is fully occupied by audience. As shown in the figure, the reverberation time frequency characteristics of a reverberation sound change with the size of audience in the hall. On the other hand, the third embodiment allows the user to select the size of audience in the hall as desired. The reverberation time frequency characteristic of a reverberation sound to be imparted to an input sound is in accordance with the size of audience specified by the user in the characteristic between reverberation time frequency characteristics A and B. The following describes the details thereof.

Figure 7:
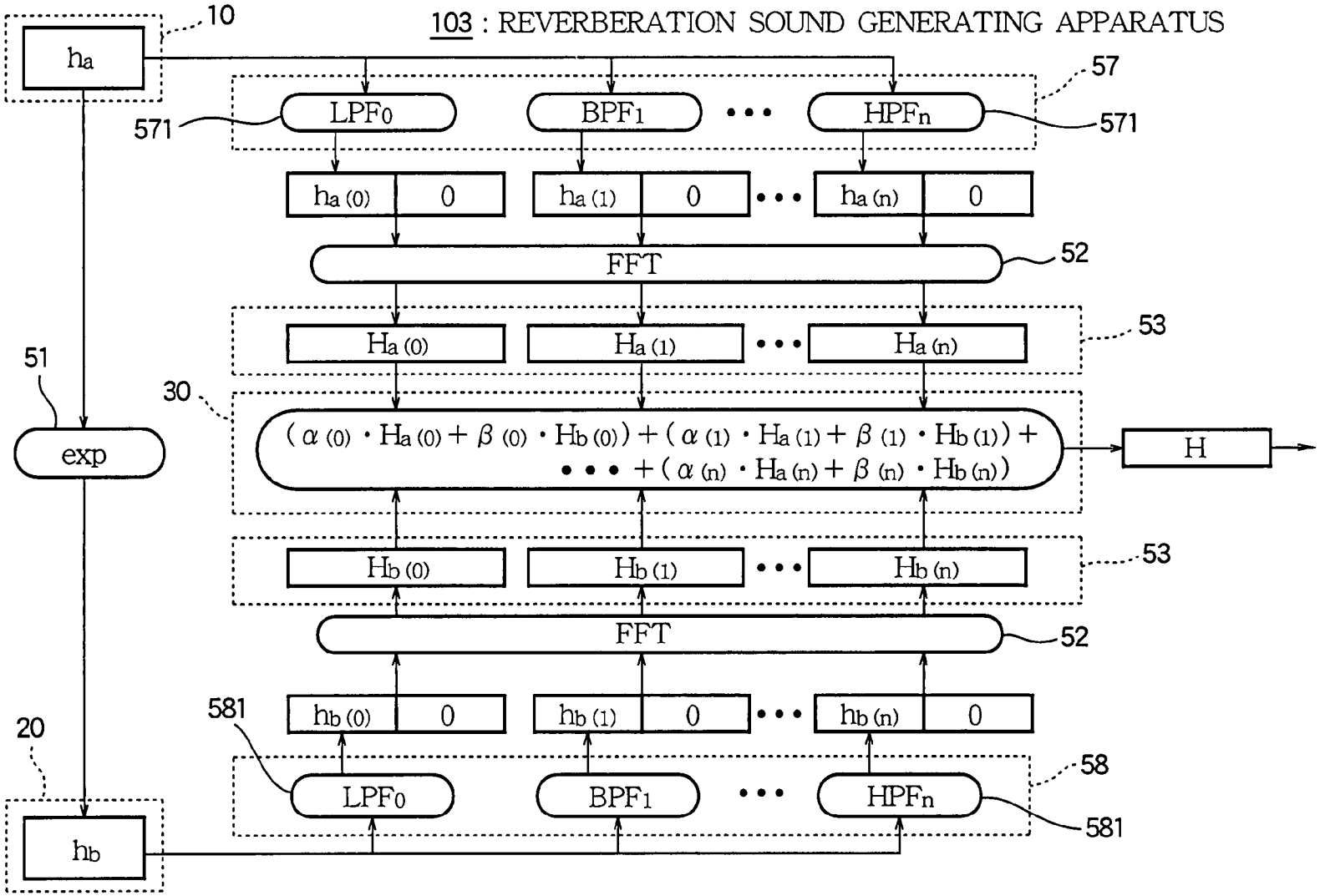
FIG. 7 is a block diagram illustrating a configuration of generating new impulse response data in a reverberation sound generating apparatus practiced as a third embodiment of the invention.

FIG. 7 is a block diagram illustrating a configuration of the reverberation sound generating apparatus associated with the third embodiment. It should be noted that, with reference to FIG. 7, components similar to those previously described with reference to FIGS. 3 and 4 are denoted by the same reference numerals. As with FIG. 5, FIG. 7 shows the configuration in which a plurality of blocks constituting each piece of impulse response data are shown as one block for the convenience of description.

As shown in the figure, a reverberation sound generating apparatus 103 has an exponent operating block 51 as with the above-mentioned first embodiment. In the third embodiment, first impulse response data ha represents the impulse response at vacant occupancy shown in FIG. 6 and second impulse response data hb generated by the exponent operating block 51 represents the impulse response at full occupancy shown in FIG. 6.

A first filter group 57 shown in FIG. 7 has (n+1) filters 571. Each filter 571 selectively passes a frequency component of a particular band in the first impulse response. The pass band of each filter 571 of the first filter group 57 is set such that the pass band does not overlap those of the other filters of this group. Consequently, the first impulse response data ha are converted into frequency component element block Ha(i) (i being an integer satisfying 0=i=n) for each different frequency component and the frequency element block Ha(i) is supplied to a new data creating section 30. A second filter group 58 into which second impulse response data hb are inputted the same configuration as that of the first filter group 57 and has a plurality of filters 581 of which pass bands do not overlap each other. Consequently, the second impulse response data hb are converted into frequency element block Hb(i) for each different frequency component and the frequency element block Hb(i) is supplied to the new data creating section 30.

On the other hand, the new data creating section 30 linearly combines the first frequency element block Ha(i) with the second frequency element block Hb(i) and sums the results obtained by the linear combination executed for each frequency component, thereby generating a new impulse response block (new impulse data) H. Namely, the new impulse response block H is computed from equation (3) shown below.

$$H = \sum_i \{\alpha(i) \cdot Ha(i) + \beta(i) \cdot Hb(i)\} \tag{3}$$

where coefficients a(i) and (i) for use in the linear combination for each frequency component are given by equations (4a) and (4b) shown below respectively.

$$\alpha(i) = \frac{c^{\left(\frac{T0}{RTx(i)} + \frac{T1}{RT2(i)}\right)} - c^{\left(\frac{T1}{RTx(i)} + \frac{T0}{RT2(i)}\right)}}{c^{\left(\frac{T0}{RT1(i)} + \frac{T1}{RT2(i)}\right)} - c^{\left(\frac{T1}{RT1(i)} + \frac{T0}{RT2(i)}\right)}} \tag{4a}$$

$$\beta(i) = \frac{c^{\left(\frac{T0}{RT1(i)} + \frac{T1}{RTx(i)}\right)} - c^{\left(\frac{T1}{RT1(i)} + \frac{T0}{RTx(i)}\right)}}{c^{\left(\frac{T0}{RT1(i)} + \frac{T1}{RT2(i)}\right)} - c^{\left(\frac{T1}{RT1(i)} + \frac{T0}{RT2(i)}\right)}} \tag{4b}$$

In equations (4a) and (4b) shown above, T0, T1, and c denote the same as those in equations (2a) and (1b) mentioned above. RT1(i) denotes the reverberation time of a frequency component belonging to the i-th band in the first impulse response and RT2(i) denotes the reverberation time of a frequency component belonging to the i-th band in the second impulse response. RTx(i) denotes the reverberation time of a frequency component belonging to the i-th band and is appropriately chosen in accordance with user instruction. For example, the value of RTx(i) is selected for each frequency component such that, as the size of audience specified by the user gets smaller, the new impulse response data H approach characteristic A shown in FIG. 6; as the size of audience gets larger, the new impulse response data H approach characteristic B shown in FIG. 5. The subsequent operations are the same as those of the first embodiment.

The third embodiments also provides the same effects as those of the first embodiment. Moreover, according to the third embodiment, the first and second impulse response data are divided into a plurality of frequency components and then the linear combination using appropriate coefficients is executed on each of the frequency components, so that the user may select a desired reverberation sound characteristic for each frequency component.

<4: Variations>

While the preferred embodiments of the present invention have been described using specific terms, such description is for illustrative purposes only, and it is to be understood that changes and variations may be made without departing from the spirit or scope of the appended claims. For example, the following variations are possible.

<4-1: Variation 1>

Each of the above-mentioned embodiments, a configuration is presented in which second impulse response data hb are obtained by converting first impulse response data ha. Alternatively, the second impulse response data hb may be prepared regardless of the first impulse response data ha.

<4-2: Variation 2>

In each of the above-mentioned embodiments and variation, a configuration is presented in which the first and second impulse response data are converted into data along the frequency axis and the converted data are multiplied by an input sound block, which is data along the frequency axis. Alternatively, both the data may be used as they are along the time axis for convoluting computation. However, the configuration in which reverberation sound data are generated by converting the first and second impulse response data and the input sound data into data along the frequency axis provides an advantage of an decreased computational amount as compared with the configuration in which convoluting computation is executed on the data as they are along the time axis.

<4-3: Variation 3>

In each of the above-mentioned embodiments and variations, a configuration is presented in which reverberation sound characteristics are changed, but not exclusively, in accordance with user instruction. For example, a configuration may be provided in which reverberation sound characteristics may be changed in accordance with hardware or software constituting the reverberation sound generating apparatus.

<4-4: Variation 4>

In each of the above-mentioned embodiments and variations, a configuration is presented in which new impulse response data are obtained by, but not exclusively, linearly combining first impulse response data ha and second impulse response data hb. Essentially, any computation that obtains new impulse response data from first impulse response data ha and second impulse response data hb as instructed by the user may be used. However, the linear combination used in each of the above-mentioned embodiments presents an advantage of significantly simplifying the computation processing.

As described and according to the invention, the reverberation sound characteristics may be finely and continuously changed while reducing the amount of the impulse response data which must be stored in advance.

What is claimed is:

1. An apparatus for generating a reverberation sound from an input sound with use of an impulse response based on an instruction, the apparatus comprising:

a first storage section that stores first impulse response data representative of a first impulse response;

a second storage section that stores second impulse response data representative of a second impulse response which is different from the first impulse response represented by the first impulse response data;

a new data creating section that operates based on the first impulse response data and the second impulse response data for creating new impulse response data representative of a new impulse response in accordance with the instruction; and a reverberation sound generating section that generates reverberation sound data representative of the reverberation sound by filtering input sound data representative of the input sound with use of the new impulse response data, such that the generated reverberation sound is featured by the new impulse response, wherein the new data creating section divides the first impulse response data into a sequence of first blocks along a time axis, divides the second impulse response data into a sequence of second blocks along the time axis, and creates a sequence of blocks of the new impulse response data arranged along the time axis in correspondence to the sequence of the first blocks of the first impulse response data and the sequence of the second blocks of the second impulse response data.

2. The apparatus according to claim 1, wherein the second storage section stores the second impulse response data representative of the second impulse response which has a reverberation time different from that of the first impulse response represented by the first impulse response data, and the new data creating section creates the new impulse response data representative of the new impulse response having a reverberation time which is derived from the reverberation times of the first impulse response and the second impulse response in accordance with the instruction.

3. The apparatus according to claim 1, wherein the second storage section stores the second impulse response data representative of the second impulse response which has a frequency characteristic different from that of the first impulse response represented by the first impulse response data, and the new data creating section creates the new impulse response data representative of the new impulse response having a frequency characteristic which is derived from the frequency characteristics of the first impulse response and the second impulse response in accordance with the instruction.

4. The apparatus according to claim 1, wherein the new data creating section creates the new impulse response data by linearly combining the first impulse response data and the second impulse response data with each other in accordance with the instruction.

5. The apparatus according to claim 1, wherein the second storage section stores the second impulse response data which is obtained by manipulating the first impulse response data.

6. The apparatus according to claim 1, wherein the reverberation sound generating section divides the input sound data into a sequence of blocks along the time axis in correspondence to the sequence of the blocks of the new impulse response data, then filters each block of the input sound data with use of each block of the new impulse response data, and sums the filtered results altogether to generate the reverberation sound data.

7. The apparatus according to claim 1, wherein the new data creating section separates the first impulse response data into a plurality of frequency components, also separates the second impulse response data into a plurality of frequency components, then executes a computation for each of the plurality of the frequency components between the first impulse response data and the second impulse response data according to the instruction, and sums results of the computation altogether to generate the new impulse response data.

8. A program, embodied on a computer-readable medium, for causing a computer to execute a method of generating a reverberation sound from an input sound with use of an impulse response based on an instruction, said method comprising the steps of:

a first providing step of providing first impulse response data representative of a first impulse response;

a second providing step of providing second impulse response data representative of a second impulse response which is different from the first impulse response represented by the first impulse response data;

a new data creating step of creating new impulse response data representative of a new impulse response based on the first impulse response data and the second impulse response data in accordance with the instruction; and a reverberation sound generating step of generating reverberation sound data representative of the reverberation sound by filtering input sound data representative of the input sound with use of the new impulse response data, such that the generated reverberation sound is featured by the new impulse response, wherein the new data creating step divides the first impulse response data into a sequence of first blocks along a time axis, divides the second impulse response data into a sequence of second blocks along the time axis, and creates a sequence of blocks of the new impulse response data arranged along the time axis in correspondence to the sequence of the first blocks of the first impulse response data and the sequence of the second blocks of the second impulse response data.

9. The program according to claim 8, wherein the second providing step provides the second impulse response data representative of the second impulse response which has a reverberation time different from that of the first impulse response represented by the first impulse response data, and the new data creating step creates the new impulse response data representative of the new impulse response having a reverberation time which is derived from the reverberation times of the first impulse response and the second impulse response in accordance with the instruction.

10. The program according to claim 8, wherein the second providing step provides the second impulse response data representative of the second impulse response which has a frequency characteristic different from that of the first impulse response represented by the first impulse response data, and the new data creating step creates the new impulse response data representative of the new impulse response having a frequency characteristic which is derived from the frequency characteristics of the first impulse response and the second impulse response in accordance with the instruction.

11. The program according to claim 8, wherein the new data creating step creates the new impulse response data by linearly combining the first impulse response data and the second impulse response data with each other in accordance with the instruction.

12. The program according to claim 8, wherein the second providing step provides the second impulse response data which is obtained by manipulating the first impulse response data.

13. The program according to claim 8, wherein the reverberation sound generating step divides the input sound data into a sequence of blocks along the time axis in correspondence to the sequence of the blocks of the new impulse response data, then filters each block of the input sound data with use of each block of the new impulse response data, and sums the filtered results altogether to generate the reverberation sound data.

14. The program according to claim 8, wherein the new data creating step separates the first impulse response data into a plurality of frequency components, also separates the second impulse response data into a plurality of frequency components, then executes a computation for each of the plurality of the frequency components between the first impulse response data and the second impulse response data according to the instruction, and sums results of the computation altogether to generate the new impulse response data.

15. A method of generating a reverberation sound from an input sound with use of an impulse response based on an instruction, the method comprising the steps of:

providing first impulse response data representative of a first impulse response;

providing second impulse response data representative of a second impulse response which is different from the first impulse response represented by the first impulse response data;

creating new impulse response data representative of a new impulse response based on the first impulse response data and the second impulse response data in accordance with the instruction; and generating reverberation sound data representative of the reverberation sound by filtering input sound data representative of the input sound with use of the new impulse response data, such that the generated reverberation sound is featured by the new impulse response, wherein the new data creating step divides the first impulse response data into a sequence of first blocks along a time axis, divides the second impulse response data into a sequence of second blocks along the time axis, and creates a sequence of blocks of the new impulse response data arranged along the time axis in correspondence to the sequence of the first blocks of the first impulse response data and the sequence of the second blocks of the second impulse response data.

* * * * *